US009190744B2

(12) United States Patent
Burris

(10) Patent No.: US 9,190,744 B2
(45) Date of Patent: Nov. 17, 2015

(54) COAXIAL CABLE CONNECTOR WITH RADIO FREQUENCY INTERFERENCE AND GROUNDING SHIELD

(75) Inventor: Donald Andrew Burris, Peoria, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 115 days.

(21) Appl. No.: 13/605,481

(22) Filed: Sep. 6, 2012

(65) Prior Publication Data

US 2013/0065433 A1 Mar. 14, 2013

Related U.S. Application Data

(60) Provisional application No. 61/534,600, filed on Sep. 14, 2011.

(51) Int. Cl.
*H01R 9/05* (2006.01)
*H01R 13/6581* (2011.01)

(52) U.S. Cl.
CPC ..... *H01R 9/05* (2013.01); *H01R 13/6581* (2013.01)

(58) Field of Classification Search
USPC ..... 439/578, 583
IPC ..... H01R 2103/00,24/40, 24/564, 9/0521, H01R 9/0524, 9/0518
See application file for complete search history.

(56) References Cited

U.S. PATENT DOCUMENTS

| | | | |
|---|---|---|---|
| 331,169 | A | 11/1885 | Thomas |
| 346,958 | A | 8/1886 | Stone |
| 459,951 | A | 9/1891 | Warner |
| 589,216 | A | 8/1897 | McKee |
| 1,371,742 | A | 3/1921 | Dringman |
| 1,488,175 | A | 3/1924 | Strandell |
| 1,667,485 | A | 4/1928 | MacDonald |
| 1,766,869 | A | 6/1930 | Austin |

(Continued)

FOREIGN PATENT DOCUMENTS

| | | |
|---|---|---|
| CA | 2096710 | 11/1994 |
| CN | 201149936 | 11/2008 |

(Continued)

OTHER PUBLICATIONS

Corning Cabelcon waterproof CX3 7.0 QuickMount for RG6 cables; Cabelcon Connectors; www.cabelcom.dk; Mar. 15, 2012.

(Continued)

*Primary Examiner* — Hien Vu

(57) ABSTRACT

A radio frequency interference (RFI) and grounding shield for a coaxial cable connector is disclosed. The shield comprises a circular inner segment and at least one arcuately shaped pre-formed cantilevered annular beam attached to the circular inner segment by a joining segment. The at least one pre-formed cantilevered annular beam extends angularly from a plane of the circular inner segment. The at least one pre-formed cantilevered annular beam applies a spring-force to a surface of the surface of a component of the coaxial cable connector establishing an electrically conductive path between the components. The at least one pre-formed cantilevered annular beam comprises an outer surface with a knife-like edge that provides a wiping action of surface oxides on component surfaces of the coaxial cable connector and allows for unrestricted movement when the coaxial cable connector is attached to an equipment connection port of an appliance.

20 Claims, 6 Drawing Sheets

(56) References Cited

U.S. PATENT DOCUMENTS 1,801,999 A 4/1931 Bowman
1,885,761 A 11/1932 Peirce, Jr.
1,959,302 A 5/1934 Paige
2,013,526 A 9/1935 Schmitt
2,059,920 A 11/1936 Weatherhead, Jr.
2,102,495 A 12/1937 England
2,258,528 A 10/1941 Wurzburger
2,258,737 A 10/1941 Browne
2,325,549 A 7/1943 Ryzowitz
2,480,963 A 9/1949 Quinn
2,544,654 A 3/1951 Brown
2,549,647 A 4/1951 Turenne
2,694,187 A 11/1954 Nash
2,705,652 A 4/1955 Kaiser
2,754,487 A 7/1956 Carr et al.
2,755,331 A 7/1956 Melcher
2,757,351 A 7/1956 Klostermann
2,762,025 A 9/1956 Melcher
2,785,384 A 3/1957 Wickesser
2,805,399 A 9/1957 Leeper
2,816,949 A 12/1957 Curtiss
2,870,420 A 1/1959 Malek
2,878,039 A 3/1959 Hoegee et al.
2,881,406 A 4/1959 Arson
2,963,536 A 12/1960 Kokalas
3,001,169 A 9/1961 Blonder
3,015,794 A 1/1962 Kishbaugh
3,051,925 A 8/1962 Felts
3,091,748 A 5/1963 Takes et al.
3,094,364 A 6/1963 Lingg
3,103,548 A 9/1963 Concelman
3,106,548 A 10/1963 Lavalou
3,140,106 A 7/1964 Thomas et al.
3,184,706 A 5/1965 Atkins
3,194,292 A 7/1965 Borowsky
3,196,382 A 7/1965 Morello, Jr.
3,206,540 A 9/1965 Cohen
3,245,027 A 4/1966 Ziegler, Jr.
3,275,913 A 9/1966 Blanchard et al.
3,278,890 A 10/1966 Cooney
3,281,756 A 10/1966 O'Keefe et al.
3,281,757 A 10/1966 Bonhomme
3,290,069 A 12/1966 Davis
3,292,136 A 12/1966 Somerset
3,320,575 A 5/1967 Brown et al.
3,321,732 A 5/1967 Forney, Jr.
3,336,563 A 8/1967 Hyslop
3,348,186 A 10/1967 Rosen
3,350,667 A 10/1967 Shreve
3,350,677 A 10/1967 Daum
3,355,698 A 11/1967 Keller
3,372,364 A 3/1968 O'Keefe et al.
3,373,243 A 3/1968 Janowiak et al.
3,390,374 A 6/1968 Forney, Jr.
3,406,373 A 10/1968 Forney, Jr.
3,430,184 A 2/1969 Acord
3,448,430 A 6/1969 Kelly
3,453,376 A 7/1969 Ziegler, Jr. et al.
3,465,281 A 9/1969 Florer
3,475,545 A 10/1969 Stark et al.
3,494,400 A 2/1970 McCoy et al.
3,498,647 A 3/1970 Schroder
3,499,671 A 3/1970 Osborne
3,501,737 A 3/1970 Harris et al.
3,517,373 A 6/1970 Jamon
3,526,871 A 9/1970 Hobart
3,533,051 A 10/1970 Ziegler, Jr.
3,537,065 A 10/1970 Winston
3,544,705 A 12/1970 Winston
3,551,882 A 12/1970 O'Keefe
3,564,487 A 2/1971 Upstone et al.
3,587,033 A 6/1971 Brorein et al.
3,596,933 A 8/1971 Luckenbill
3,601,776 A 8/1971 Curl
3,603,912 A 9/1971 Kelly
3,614,711 A 10/1971 Anderson et al.
3,622,952 A 11/1971 Hilbert
3,629,792 A 12/1971 Dorrell
3,633,150 A 1/1972 Schwartz
3,646,502 A 2/1972 Hutter et al.
3,663,926 A 5/1972 Brandt
3,665,371 A 5/1972 Cripps
3,668,612 A 6/1972 Nepovim
3,669,472 A * 6/1972 Nadsady ..... 285/87
3,671,922 A 6/1972 Zerlin et al.
3,671,926 A 6/1972 Nepovim
3,678,444 A 7/1972 Stevens et al.
3,678,445 A 7/1972 Brancaleone
3,680,034 A 7/1972 Chow et al.
3,681,739 A 8/1972 Kornick
3,683,320 A 8/1972 Woods et al.
3,686,623 A 8/1972 Nijman
3,694,792 A 9/1972 Wallo
3,694,793 A 9/1972 Concelman
3,697,930 A 10/1972 Shirey
3,706,958 A 12/1972 Blanchenot
3,708,186 A 1/1973 Takagi et al.
3,710,005 A 1/1973 French
3,739,076 A 6/1973 Schwartz
3,744,007 A 7/1973 Horak
3,744,011 A 7/1973 Blanchenot
3,761,870 A 9/1973 Drezin et al.
3,778,535 A 12/1973 Forney, Jr.
3,781,762 A 12/1973 Quackenbush
3,781,898 A 12/1973 Holloway
3,783,178 A 1/1974 Philibert et al.
3,787,796 A 1/1974 Barr
3,793,610 A 2/1974 Brishka
3,798,589 A 3/1974 Deardurff
3,808,580 A 4/1974 Johnson
3,810,076 A 5/1974 Hutter
3,835,443 A 9/1974 Arnold et al.
3,836,700 A 9/1974 Niemeyer
3,845,453 A 10/1974 Hemmer
3,846,738 A 11/1974 Nepovim
3,854,003 A 12/1974 Duret
3,854,789 A 12/1974 Kaplan
3,858,156 A 12/1974 Zarro
3,879,102 A 4/1975 Horak
3,886,301 A 5/1975 Cronin et al.
3,907,335 A 9/1975 Burge et al.
3,907,399 A 9/1975 Spinner
3,910,673 A 10/1975 Stokes
3,915,539 A 10/1975 Collins
3,936,132 A 2/1976 Hutter
3,937,547 A 2/1976 Lee-Kemp
3,953,097 A 4/1976 Graham
3,960,428 A 6/1976 Naus et al.
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
3,986,736 A 10/1976 Takagi et al.
4,017,139 A 4/1977 Nelson
4,022,966 A 5/1977 Gajajiva
4,030,742 A 6/1977 Eidelberg et al.
4,030,798 A 6/1977 Paoli
4,032,177 A 6/1977 Anderson
4,045,706 A 8/1977 Daffner et al.
4,046,451 A 9/1977 Juds et al.
4,053,200 A 10/1977 Pugner
4,056,043 A 11/1977 Sriramamurty et al.
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,100,943 A 7/1978 Terada et al.
4,106,839 A 8/1978 Cooper
4,109,126 A 8/1978 Halbeck
4,125,308 A 11/1978 Schilling

(56) References Cited

U.S. PATENT DOCUMENTS

| | | | |
|---|---|---|---|
| 4,126,372 | A | 11/1978 | Hashimoto et al. |
| 4,131,332 | A | 12/1978 | Hogendobler et al. |
| 4,136,897 | A | 1/1979 | Haluch |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,193,655 | A | 3/1980 | Herrmann, Jr. |
| 4,194,338 | A | 3/1980 | Trafton |
| 4,206,963 | A | 6/1980 | English et al. |
| 4,212,487 | A | 7/1980 | Jones et al. |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,273,405 | A | 6/1981 | Law |
| 4,280,749 | A | 7/1981 | Hemmer |
| 4,285,564 | A | 8/1981 | Spinner |
| 4,290,663 | A | 9/1981 | Fowler et al. |
| 4,296,986 | A | 10/1981 | Herrmann, Jr. |
| 4,307,926 | A | 12/1981 | Smith |
| 4,309,050 | A | 1/1982 | Legris |
| 4,310,211 | A | 1/1982 | Bunnell et al. |
| 4,322,121 | A | 3/1982 | Riches et al. |
| 4,326,769 | A | 4/1982 | Dorsey et al. |
| 4,334,730 | A | 6/1982 | Colwell et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,412,717 | A | 11/1983 | Monroe |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,464,001 | A | 8/1984 | Collins |
| 4,469,386 | A | 9/1984 | Ackerman |
| 4,470,657 | A | 9/1984 | Deacon |
| 4,477,132 | A | 10/1984 | Moser et al. |
| 4,484,792 | A | 11/1984 | Tengler et al. |
| 4,484,796 | A | 11/1984 | Sato et al. |
| 4,490,576 | A | 12/1984 | Bolante et al. |
| 4,506,943 | A | 3/1985 | Drogo |
| 4,515,427 | A | 5/1985 | Smit |
| 4,525,017 | A | 6/1985 | Schildkraut et al. |
| 4,531,790 | A | 7/1985 | Selvin |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,633 | A | 10/1985 | McGeary |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,597,621 | A | 7/1986 | Burns |
| 4,598,959 | A | 7/1986 | Selvin |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,647,135 | A | 3/1987 | Reinhardt |
| 4,650,228 | A | 3/1987 | McMills et al. |
| 4,655,159 | A | 4/1987 | McMills |
| 4,655,534 | A | 4/1987 | Stursa |
| 4,660,921 | A | 4/1987 | Hauver |
| 4,666,190 | A | 5/1987 | Yamabe et al. |
| 4,668,043 | A | 5/1987 | Saba et al. |
| 4,673,236 | A | 6/1987 | Musolff et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,690,482 | A | 9/1987 | Chamberland et al. |
| 4,691,976 | A | 9/1987 | Cowen |
| 4,703,987 | A | 11/1987 | Gallusser et al. |
| 4,703,988 | A | 11/1987 | Raux et al. |
| 4,713,021 | A | 12/1987 | Kobler |
| 4,717,355 | A | 1/1988 | Mattis |
| 4,720,155 | A | 1/1988 | Schildkraut et al. |
| 4,728,301 | A | 3/1988 | Hemmer et al. |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |
| 4,738,628 | A | 4/1988 | Rees |
| 4,739,009 | A | 4/1988 | Heide et al. |
| 4,739,126 | A | 4/1988 | Gutter et al. |
| 4,746,305 | A | 5/1988 | Nomura |
| 4,747,656 | A | 5/1988 | Miyahara et al. |
| 4,747,786 | A | 5/1988 | Hayashi et al. |
| 4,749,821 | A | 6/1988 | Linton et al. |
| 4,755,152 | A | 7/1988 | Elliot et al. |
| 4,757,297 | A | 7/1988 | Frawley |
| 4,759,729 | A | 7/1988 | Kemppainen et al. |
| 4,761,146 | A | 8/1988 | Sohoel |
| 4,772,222 | A | 9/1988 | Laudig et al. |
| 4,789,355 | A | 12/1988 | Lee |
| 4,789,759 | A | 12/1988 | Jones |
| 4,795,360 | A | 1/1989 | Newman et al. |
| 4,797,120 | A | 1/1989 | Ulery |
| 4,806,116 | A | 2/1989 | Ackerman |
| 4,807,891 | A | 2/1989 | Neher |
| 4,808,128 | A | 2/1989 | Werth |
| 4,810,017 | A | 3/1989 | Knak et al. |
| 4,813,886 | A | 3/1989 | Roos et al. |
| 4,820,185 | A | 4/1989 | Moulin |
| 4,834,675 | A | 5/1989 | Samchisen |
| 4,834,676 | A | 5/1989 | Tackett |
| 4,835,342 | A | 5/1989 | Guginsky |
| 4,836,580 | A | 6/1989 | Farrell |
| 4,836,801 | A | 6/1989 | Ramirez |
| 4,838,813 | A | 6/1989 | Pauza et al. |
| 4,846,731 | A | 7/1989 | Alwine |
| 4,854,893 | A | 8/1989 | Morris |
| 4,857,014 | A | 8/1989 | Alf et al. |
| 4,867,489 | A | 9/1989 | Patel |
| 4,867,706 | A | 9/1989 | Tang |
| 4,869,679 | A | 9/1989 | Szegda |
| 4,874,331 | A | 10/1989 | Iverson |
| 4,881,912 | A | 11/1989 | Thommen et al. |
| 4,892,275 | A | 1/1990 | Szegda |
| 4,902,246 | A | 2/1990 | Samchisen |
| 4,906,207 | A | 3/1990 | Banning et al. |
| 4,915,651 | A | 4/1990 | Bout |
| 4,921,447 | A | 5/1990 | Capp et al. |
| 4,923,412 | A | 5/1990 | Morris |
| 4,925,403 | A | 5/1990 | Zorzy |

(56) References Cited

U.S. PATENT DOCUMENTS 4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,018,822 A 5/1991 Freismuth et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gaver, Jr. et al.
5,067,912 A 11/1991 Bickford et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,150,924 A 9/1992 Yokomatsu et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,392 A 6/1993 Hosler, Sr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,281,762 A 1/1994 Long et al.
5,283,853 A 2/1994 Szegda
5,284,449 A 2/1994 Vaccaro
5,294,864 A 3/1994 Do
5,295,864 A 3/1994 Birch et al.
5,316,348 A 5/1994 Franklin
5,316,494 A 5/1994 Flanagan et al.
5,318,459 A 6/1994 Shields
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,362,251 A 11/1994 Bielak
5,366,260 A 11/1994 Wartluft
5,371,819 A 12/1994 Szegda
5,371,821 A 12/1994 Szegda
5,371,827 A 12/1994 Szegda
5,380,211 A 1/1995 Kawaguchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,435,751 A 7/1995 Papenheim et al.
5,435,760 A 7/1995 Miklos
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,488,268 A 1/1996 Bauer et al.
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,566,173 A 10/1996 Steinbrecher
5,571,028 A 11/1996 Szegda
5,586,910 A 12/1996 Del Negro et al.
5,595,499 A 1/1997 Zander et al.
5,598,132 A 1/1997 Stabile
5,607,320 A 3/1997 Wright
5,607,325 A 3/1997 Toma
5,609,501 A 3/1997 McMills et al.
5,620,339 A 4/1997 Gray et al.
5,632,637 A 5/1997 Diener
5,632,651 A 5/1997 Szegda
5,644,104 A 7/1997 Porter et al.
5,649,723 A 7/1997 Larsson
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,743,131 A 4/1998 Holliday et al.
5,746,617 A 5/1998 Porter, Jr. et al.
5,746,619 A 5/1998 Harting et al.
5,769,652 A 6/1998 Wider
5,774,344 A 6/1998 Casebolt
5,775,927 A 7/1998 Wider
5,788,289 A 8/1998 Cronley
5,791,698 A 8/1998 Wartluft et al.
5,797,633 A 8/1998 Katzer et al.
5,817,978 A 10/1998 Hermant et al.
5,863,220 A 1/1999 Holliday
5,877,452 A 3/1999 McConnell
5,879,191 A 3/1999 Burris
5,882,226 A 3/1999 Bell et al.
5,897,795 A 4/1999 Lu et al.
5,906,511 A 5/1999 Bozzer et al.
5,917,153 A 6/1999 Geroldinger
5,921,793 A 7/1999 Phillips
5,938,465 A 8/1999 Fox, Sr.

(56) References Cited

U.S. PATENT DOCUMENTS

| | | | |
|---|---|---|---|
| 5,944,548 | A | 8/1999 | Saito |
| 5,951,327 | A | 9/1999 | Marik |
| 5,954,708 | A | 9/1999 | Lopez et al. |
| 5,957,716 | A | 9/1999 | Buckley et al. |
| 5,967,852 | A | 10/1999 | Follingstad et al. |
| 5,975,479 | A | 11/1999 | Suter |
| 5,975,591 | A | 11/1999 | Guest |
| 5,975,949 | A | 11/1999 | Holliday et al. |
| 5,975,951 | A | 11/1999 | Burris et al. |
| 5,977,841 | A | 11/1999 | Lee et al. |
| 5,997,350 | A | 12/1999 | Burris et al. |
| 6,010,349 | A | 1/2000 | Porter, Jr. |
| 6,019,635 | A | 2/2000 | Nelson |
| 6,022,237 | A | 2/2000 | Esh |
| 6,032,358 | A | 3/2000 | Wild |
| 6,036,540 | A | 3/2000 | Beloritsky |
| 6,042,422 | A | 3/2000 | Youtsey |
| 6,048,229 | A | 4/2000 | Lazaro, Jr. |
| 6,053,743 | A | 4/2000 | Mitchell et al. |
| 6,053,769 | A | 4/2000 | Kubota et al. |
| 6,053,777 | A | 4/2000 | Boyle |
| 6,062,607 | A | 5/2000 | Bartholomew |
| 6,080,015 | A | 6/2000 | Andreescu |
| 6,083,053 | A | 7/2000 | Anderson, Jr. et al. |
| 6,089,903 | A | 7/2000 | Stafford Gray et al. |
| 6,089,912 | A | 7/2000 | Tallis et al. |
| 6,089,913 | A | 7/2000 | Holliday |
| 6,093,043 | A | 7/2000 | Gray et al. |
| 6,095,828 | A | 8/2000 | Burland |
| 6,095,841 | A | 8/2000 | Felps |
| 6,123,550 | A | 9/2000 | Burkert et al. |
| 6,123,567 | A | 9/2000 | McCarthy |
| 6,132,234 | A | 10/2000 | Waidner et al. |
| 6,146,197 | A | 11/2000 | Holliday et al. |
| 6,152,752 | A | 11/2000 | Fukuda |
| 6,152,753 | A | 11/2000 | Johnson et al. |
| 6,153,830 | A | 11/2000 | Montena |
| 6,158,298 | A | 12/2000 | Hara |
| 6,162,995 | A | 12/2000 | Bachle et al. |
| 6,164,977 | A | 12/2000 | Lester |
| 6,174,206 | B1 | 1/2001 | Yentile et al. |
| 6,183,298 | B1 | 2/2001 | Henningsen |
| 6,199,913 | B1 | 3/2001 | Wang |
| 6,199,920 | B1 | 3/2001 | Neustadtl |
| 6,210,216 | B1 | 4/2001 | Tso-Chin et al. |
| 6,210,219 | B1 | 4/2001 | Zhu et al. |
| 6,210,222 | B1 | 4/2001 | Langham et al. |
| 6,217,383 | B1 | 4/2001 | Holland et al. |
| 6,238,240 | B1 | 5/2001 | Yu |
| 6,239,359 | B1 | 5/2001 | Lilienthal, II et al. |
| 6,241,553 | B1 | 6/2001 | Hsia |
| 6,250,974 | B1 | 6/2001 | Kerek |
| 6,257,923 | B1 | 7/2001 | Stone et al. |
| 6,261,126 | B1 | 7/2001 | Stirling |
| 6,267,612 | B1 | 7/2001 | Arcykiewicz et al. |
| 6,271,464 | B1 | 8/2001 | Cunningham |
| 6,331,123 | B1 | 12/2001 | Rodrigues |
| 6,332,815 | B1 | 12/2001 | Bruce |
| 6,352,448 | B1 | 3/2002 | Holliday et al. |
| 6,358,077 | B1 | 3/2002 | Young |
| 6,361,348 | B1 | 3/2002 | Hall et al. |
| 6,361,364 | B1 | 3/2002 | Holland et al. |
| 6,375,509 | B2 | 4/2002 | Mountford |
| 6,394,840 | B1 | 5/2002 | Gassauer et al. |
| 6,396,367 | B1 | 5/2002 | Rosenberger |
| D458,904 | S | 6/2002 | Montena |
| 6,406,330 | B2 | 6/2002 | Bruce |
| 6,409,534 | B1 | 6/2002 | Weisz-Margulescu |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,884 | B1 | 7/2002 | Babasick et al. |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| 6,439,899 | B1 | 8/2002 | Muzslay et al. |
| D462,327 | S | 9/2002 | Montena |
| 6,450,829 | B1 | 9/2002 | Weisz-Margulescu |
| 6,454,463 | B1 | 9/2002 | Halbach et al. |
| 6,464,526 | B1 | 10/2002 | Seufert et al. |
| 6,467,816 | B1 | 10/2002 | Huang |
| 6,468,100 | B1 | 10/2002 | Meyer et al. |
| 6,491,546 | B1 | 12/2002 | Perry |
| D468,696 | S | 1/2003 | Montena |
| 6,506,083 | B1 | 1/2003 | Bickford et al. |
| 6,520,800 | B1 | 2/2003 | Michelbach et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,634,906 | B1 | 10/2003 | Yeh |
| 6,663,397 | B1 | 12/2003 | Lin et al. |
| 6,676,446 | B2 | 1/2004 | Montena |
| 6,683,253 | B1 | 1/2004 | Lee |
| 6,690,081 | B2 | 2/2004 | Bakir et al. |
| 6,692,285 | B2 | 2/2004 | Islam |
| 6,692,286 | B1 | 2/2004 | De Cet |
| 6,695,636 | B2 | 2/2004 | Hall et al. |
| 6,705,875 | B2 | 3/2004 | Berghorn et al. |
| 6,705,884 | B1 | 3/2004 | McCarthy |
| 6,709,280 | B1 | 3/2004 | Gretz |
| 6,712,631 | B1 | 3/2004 | Youtsey |
| 6,716,041 | B2 | 4/2004 | Ferderer et al. |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,752,633 | B2 | 6/2004 | Aizawa et al. |
| 6,761,571 | B2 | 7/2004 | Hida |
| 6,767,248 | B1 | 7/2004 | Hung |
| 6,769,926 | B1 | 8/2004 | Montena |
| 6,780,029 | B1 | 8/2004 | Gretz |
| 6,780,042 | B1 | 8/2004 | Badescu et al. |
| 6,780,052 | B2 | 8/2004 | Montena et al. |
| 6,780,068 | B2 | 8/2004 | Bartholoma et al. |
| 6,783,394 | B1 | 8/2004 | Holliday |
| 6,786,767 | B1 | 9/2004 | Fuks et al. |
| 6,790,081 | B2 | 9/2004 | Burris et al. |
| 6,793,528 | B2 | 9/2004 | Lin et al. |
| 6,802,738 | B1 | 10/2004 | Henningsen |
| 6,805,583 | B2 | 10/2004 | Holliday et al. |
| 6,805,584 | B1 | 10/2004 | Chen |
| 6,808,415 | B1 | 10/2004 | Montena |
| 6,817,272 | B2 | 11/2004 | Holland |
| 6,817,896 | B2 | 11/2004 | Derenthal |
| 6,817,897 | B2 | 11/2004 | Chee |
| 6,827,608 | B2 | 12/2004 | Hall et al. |
| 6,830,479 | B2 | 12/2004 | Holliday |
| 6,848,115 | B2 | 1/2005 | Sugiura et al. |
| 6,848,939 | B2 | 2/2005 | Stirling |
| 6,848,940 | B2 | 2/2005 | Montena |
| 6,848,941 | B2 | 2/2005 | Wlos et al. |
| 6,884,113 | B1 | 4/2005 | Montena |
| 6,884,115 | B2 | 4/2005 | Malloy |
| 6,887,102 | B1 | 5/2005 | Burris et al. |
| 6,929,265 | B2 | 8/2005 | Holland et al. |
| 6,929,508 | B1 | 8/2005 | Holland |
| 6,935,866 | B2 | 8/2005 | Kerekes et al. |
| 6,939,169 | B2 | 9/2005 | Islam et al. |
| 6,942,516 | B2 | 9/2005 | Shimoyama et al. |
| 6,942,520 | B2 | 9/2005 | Barlian et al. |
| 6,945,805 | B1 | 9/2005 | Bollinger |
| 6,948,976 | B2 | 9/2005 | Goodwin et al. |
| 6,953,371 | B2 | 10/2005 | Baker et al. |
| 6,955,563 | B1 | 10/2005 | Croan |
| 6,971,912 | B2 | 12/2005 | Montena et al. |
| 7,008,263 | B2 | 3/2006 | Holland |

(56) References Cited

U.S. PATENT DOCUMENTS 7,018,216 B1 3/2006 Clark et al.
7,018,235 B1 3/2006 Burris et al.
7,029,326 B2 4/2006 Montena
7,063,565 B2 6/2006 Ward
7,070,447 B1 7/2006 Montena
7,077,697 B2 7/2006 Kooiman
7,086,897 B2 8/2006 Montena
7,090,525 B1 8/2006 Morana
7,094,114 B2 8/2006 Kurimoto
7,097,499 B1 8/2006 Purdy
7,102,868 B2 9/2006 Montena
7,108,547 B2 9/2006 Kisling et al.
7,112,078 B2 9/2006 Czikora
7,112,093 B1 9/2006 Holland
7,114,990 B2 10/2006 Bence et al. ..... 439/583
7,118,285 B2 10/2006 Fenwick et al.
7,118,382 B2 10/2006 Kerekes et al.
7,118,416 B2 10/2006 Montena et al.
7,125,283 B1 10/2006 Lin
7,128,604 B2 10/2006 Hall
7,131,867 B1 11/2006 Foster et al.
7,131,868 B2 11/2006 Montena
7,140,645 B2 11/2006 Cronley
7,144,271 B1 12/2006 Burris et al.
7,147,509 B1 12/2006 Burris et al.
7,156,696 B1 1/2007 Montena
7,161,785 B2 1/2007 Chawgo
7,165,974 B2 1/2007 Kooiman
7,173,121 B2 2/2007 Fang
7,179,121 B1 2/2007 Burris et al.
7,179,122 B2 2/2007 Holliday
7,182,639 B2 2/2007 Burris
7,189,114 B1 3/2007 Burris et al.
7,192,308 B2 3/2007 Rodrigues et al.
7,229,303 B2 6/2007 Vermoesen et al.
7,238,047 B2 7/2007 Saettele et al.
7,252,536 B2 8/2007 Lazaro, Jr. et al.
7,252,546 B1 8/2007 Holland
7,255,598 B2 8/2007 Montena et al.
7,261,594 B2 8/2007 Kodama et al.
7,264,502 B2 9/2007 Holland
7,278,882 B1 10/2007 Li
7,288,002 B2 10/2007 Rodrigues et al.
7,291,033 B2 11/2007 Hu
7,297,023 B2 11/2007 Chawgo
7,299,550 B2 11/2007 Montena
7,318,609 B2 1/2008 Naito et al.
7,322,846 B2 1/2008 Camelio
7,322,851 B2 1/2008 Brookmire
7,329,139 B2 2/2008 Benham
7,335,058 B1 2/2008 Burris et al.
7,347,129 B1 3/2008 Youtsey
7,347,726 B2 3/2008 Wlos
7,347,727 B2 3/2008 Wlos et al.
7,347,729 B2 3/2008 Thomas et al.
7,351,088 B1 4/2008 Qu
7,357,641 B2 4/2008 Kerekes et al.
7,364,462 B2 4/2008 Holland
7,371,112 B2 5/2008 Burris et al.
7,375,533 B2 5/2008 Gale
7,387,524 B2 6/2008 Cheng
7,393,245 B2 7/2008 Palinkas et al.
7,396,249 B2 7/2008 Kauffman
7,404,737 B1 7/2008 Youtsey
7,410,389 B2 8/2008 Holliday
7,416,415 B2 8/2008 Hart et al.
7,438,327 B2 10/2008 Auray et al.
7,452,239 B2 11/2008 Montena
7,455,550 B1 11/2008 Sykes
7,458,850 B1 12/2008 Burris et al.
7,458,851 B2 12/2008 Montena
7,462,068 B2 12/2008 Amidon
7,467,980 B2 12/2008 Chiu
7,476,127 B1 1/2009 Wei
7,478,475 B2 1/2009 Hall
7,479,033 B1 1/2009 Sykes et al.
7,479,035 B2 * 1/2009 Bence et al. ..... 439/583
7,484,988 B2 2/2009 Ma et al.
7,484,997 B2 2/2009 Hofling
7,488,210 B1 2/2009 Burris et al.
7,494,355 B2 2/2009 Hughes et al.
7,497,729 B1 3/2009 Wei
7,500,868 B2 3/2009 Holland et al.
7,500,873 B1 3/2009 Hart
7,507,116 B2 3/2009 Laerke et al.
7,507,117 B2 3/2009 Amidon
7,513,788 B2 4/2009 Camelio
7,544,094 B1 6/2009 Paglia et al.
7,563,133 B2 7/2009 Stein
7,566,236 B2 7/2009 Malloy et al.
7,568,945 B2 8/2009 Chee et al.
7,578,693 B2 8/2009 Yoshida et al.
7,588,454 B2 9/2009 Nakata et al.
7,607,942 B1 10/2009 Van Swearingen
7,625,227 B1 12/2009 Henderson et al.
7,632,143 B1 12/2009 Islam
7,635,283 B1 12/2009 Islam
7,651,376 B2 1/2010 Schreier
7,674,132 B1 3/2010 Chen
7,682,177 B2 3/2010 Berthet
7,682,188 B1 3/2010 Lu
7,714,229 B2 5/2010 Burris et al.
7,727,011 B2 6/2010 Montena et al.
7,749,021 B2 7/2010 Brodeur
7,753,705 B2 7/2010 Montena
7,753,710 B2 7/2010 George
7,753,727 B1 7/2010 Islam et al.
7,758,370 B1 7/2010 Flaherty
7,794,275 B2 9/2010 Rodrigues
7,806,714 B2 10/2010 Williams et al.
7,806,725 B1 10/2010 Chen
7,811,133 B2 10/2010 Gray
D626,920 S 11/2010 Purdy et al.
7,824,216 B2 11/2010 Purdy
7,828,595 B2 11/2010 Mathews
7,830,154 B2 11/2010 Gale
7,833,053 B2 11/2010 Mathews
7,845,976 B2 12/2010 Mathews
7,845,978 B1 12/2010 Chen
7,845,980 B1 12/2010 Amidon
7,850,472 B2 12/2010 Friedrich et al.
7,850,487 B1 12/2010 Wei
7,857,661 B1 12/2010 Islam
7,874,870 B1 1/2011 Chen
7,887,354 B2 2/2011 Holliday
7,892,004 B2 2/2011 Hertzler et al.
7,892,005 B2 2/2011 Haube
7,892,024 B1 2/2011 Chen
7,914,326 B2 3/2011 Sutter
7,918,687 B2 4/2011 Paynter et al.
7,927,135 B1 4/2011 Wlos
7,934,955 B1 5/2011 Hsia
7,942,695 B1 5/2011 Lu
7,950,958 B2 5/2011 Mathews
7,955,126 B2 6/2011 Bence et al.
7,972,158 B2 7/2011 Wild et al.
7,972,176 B2 7/2011 Burris et al.
7,982,005 B2 7/2011 Ames et al.
8,011,955 B1 9/2011 Lu
8,025,518 B2 9/2011 Burris et al.
8,029,315 B2 10/2011 Purdy et al.
8,029,316 B2 10/2011 Snyder et al.
8,062,044 B2 11/2011 Montena et al.
8,062,063 B2 11/2011 Malloy et al.
8,070,504 B2 12/2011 Amidon et al.
8,075,337 B2 12/2011 Malloy et al.
8,075,338 B1 12/2011 Montena
8,079,860 B1 12/2011 Zraik
8,087,954 B2 1/2012 Fuchs
8,113,875 B2 2/2012 Malloy et al.
8,113,879 B1 2/2012 Zraik
8,157,587 B2 4/2012 Paynter et al.
8,157,588 B1 4/2012 Rodrigues et al.
8,167,635 B1 5/2012 Mathews

(56) References Cited

U.S. PATENT DOCUMENTS 8,167,636 B1 * 5/2012 Montena ..... 439/322
8,172,612 B2 5/2012 Bence et al.
8,177,572 B2 5/2012 Feye-Hohmann
8,192,237 B2 6/2012 Purdy et al.
8,206,172 B2 6/2012 Katagiri et al.
D662,893 S 7/2012 Haberek et al.
8,231,412 B2 7/2012 Paglia et al.
8,262,408 B1 9/2012 Kelly
8,272,893 B2 9/2012 Burris et al.
8,287,320 B2 10/2012 Purdy et al.
8,313,345 B2 11/2012 Purdy
8,313,353 B2 11/2012 Purdy et al.
8,317,539 B2 11/2012 Stein
8,323,053 B2 12/2012 Montena
8,323,058 B2 12/2012 Flaherty et al.
8,323,060 B2 12/2012 Purdy et al.
8,337,229 B2 12/2012 Montena
8,366,481 B2 2/2013 Ehret et al.
8,376,769 B2 2/2013 Holland et al.
D678,844 S 3/2013 Haberek
8,398,421 B2 3/2013 Haberek et al.
8,449,326 B2 5/2013 Holland et al.
8,465,322 B2 6/2013 Purdy
8,469,739 B2 6/2013 Rodrigues et al.
8,469,740 B2 6/2013 Ehret et al.
D686,164 S 7/2013 Haberek et al.
D686,576 S 7/2013 Haberek et al.
8,475,205 B2 7/2013 Ehret et al.
8,480,430 B2 7/2013 Ehret et al.
8,480,431 B2 7/2013 Ehret et al.
8,485,845 B2 7/2013 Ehret et al.
8,506,325 B2 * 8/2013 Malloy et al. ..... 439/578
8,517,763 B2 * 8/2013 Burris et al. ..... 439/578
8,517,764 B2 8/2013 Wei et al.
8,529,279 B2 9/2013 Montena
8,550,835 B2 10/2013 Montena
8,568,163 B2 10/2013 Burris et al.
8,568,165 B2 10/2013 Wei et al.
8,591,244 B2 11/2013 Thomas et al.
8,597,050 B2 12/2013 Flaherty et al.
8,636,529 B2 1/2014 Stein
8,636,541 B2 1/2014 Chastain et al.
8,647,136 B2 2/2014 Purdy et al.
8,690,603 B2 4/2014 Bence et al.
8,721,365 B2 5/2014 Holland
8,727,800 B2 5/2014 Holland et al.
8,777,658 B2 7/2014 Holland et al.
8,777,661 B2 7/2014 Holland et al.
8,858,251 B2 10/2014 Montena
8,888,526 B2 11/2014 Burris
8,920,192 B2 12/2014 Montena
9,017,101 B2 4/2015 Ehret et al.
2001/0034143 A1 10/2001 Annequin
2001/0046802 A1 11/2001 Perry et al.
2001/0051448 A1 12/2001 Gonzales
2002/0013088 A1 1/2002 Rodrigues et al.
2002/0019161 A1 2/2002 Finke et al.
2002/0038720 A1 4/2002 Kai et al.
2002/0146935 A1 10/2002 Wong
2003/0110977 A1 6/2003 Batlaw
2003/0119358 A1 6/2003 Henningsen
2003/0139081 A1 7/2003 Hall et al.
2003/0194890 A1 10/2003 Ferderer et al.
2003/0214370 A1 11/2003 Allison et al.
2003/0224657 A1 12/2003 Malloy
2004/0031144 A1 2/2004 Holland
2004/0077215 A1 4/2004 Palinkas et al.
2004/0102089 A1 5/2004 Chee
2004/0157499 A1 8/2004 Nania et al.
2004/0194585 A1 10/2004 Clark
2004/0209516 A1 10/2004 Burris et al.
2004/0219833 A1 11/2004 Burris et al.
2004/0229504 A1 11/2004 Liu
2005/0042919 A1 2/2005 Montena
2005/0079762 A1 4/2005 Hsia
2005/0159045 A1 7/2005 Huang
2005/0170692 A1 8/2005 Montena
2005/0181652 A1 8/2005 Montena et al.
2005/0181668 A1 8/2005 Montena et al.
2005/0208827 A1 9/2005 Burris et al.
2005/0233636 A1 10/2005 Rodrigues et al.
2006/0014425 A1 1/2006 Montena
2006/0099853 A1 5/2006 Sattele et al.
2006/0110977 A1 5/2006 Matthews
2006/0154519 A1 7/2006 Montena
2006/0166552 A1 7/2006 Bence et al.
2006/0178046 A1 8/2006 Tusini
2006/0194465 A1 8/2006 Czikora
2006/0223355 A1 10/2006 Hirschmann
2006/0246774 A1 11/2006 Buck
2006/0258209 A1 11/2006 Hall
2006/0276079 A1 12/2006 Chen
2007/0004276 A1 1/2007 Stein
2007/0026734 A1 2/2007 Bence et al.
2007/0049113 A1 3/2007 Rodrigues et al.
2007/0054535 A1 3/2007 Hall et al.
2007/0059968 A1 3/2007 Ohtaka et al.
2007/0082533 A1 4/2007 Currier et al.
2007/0087613 A1 4/2007 Schumacher et al.
2007/0123101 A1 5/2007 Palinkas
2007/0155232 A1 7/2007 Burris et al.
2007/0173100 A1 7/2007 Benham
2007/0175027 A1 8/2007 Khemakhem et al.
2007/0232117 A1 10/2007 Singer
2007/0243759 A1 10/2007 Rodrigues et al.
2007/0243762 A1 10/2007 Burke et al.
2007/0287328 A1 12/2007 Hart et al.
2008/0032556 A1 2/2008 Schreier
2008/0102696 A1 5/2008 Montena ..... 439/578
2008/0171466 A1 7/2008 Buck et al.
2008/0200066 A1 8/2008 Hofling
2008/0200068 A1 8/2008 Aguirre
2008/0214040 A1 9/2008 Holterhoff et al.
2008/0289470 A1 11/2008 Aston
2009/0029590 A1 1/2009 Sykes et al.
2009/0098770 A1 4/2009 Bence et al.
2009/0104801 A1 4/2009 Silva
2009/0163075 A1 6/2009 Blew et al.
2009/0186505 A1 7/2009 Mathews
2009/0264003 A1 10/2009 Hertzler et al.
2009/0305560 A1 12/2009 Chen
2010/0007441 A1 1/2010 Yagisawa et al.
2010/0022125 A1 1/2010 Burris et al.
2010/0028563 A1 2/2010 Ota
2010/0055978 A1 3/2010 Montena
2010/0080563 A1 4/2010 DiFonzo et al.
2010/0081321 A1 4/2010 Malloy et al.
2010/0081322 A1 4/2010 Malloy et al.
2010/0087071 A1 4/2010 DiFonzo et al.
2010/0105246 A1 4/2010 Burris et al.
2010/0124839 A1 5/2010 Montena
2010/0130060 A1 5/2010 Islam
2010/0178799 A1 7/2010 Lee et al.
2010/0216339 A1 8/2010 Burris et al.
2010/0233901 A1 9/2010 Wild et al.
2010/0233902 A1 9/2010 Youtsey
2010/0233903 A1 9/2010 Islam
2010/0255719 A1 10/2010 Purdy
2010/0255721 A1 10/2010 Purdy et al.
2010/0279548 A1 11/2010 Montena et al.
2010/0297871 A1 11/2010 Haube
2010/0297875 A1 * 11/2010 Purdy et al. ..... 439/578
2010/0304579 A1 12/2010 Kisling
2010/0323541 A1 12/2010 Amidon et al.
2011/0021072 A1 1/2011 Purdy
2011/0021075 A1 1/2011 Orner et al.
2011/0027039 A1 2/2011 Blair
2011/0039448 A1 2/2011 Stein
2011/0053413 A1 3/2011 Mathews
2011/0074388 A1 3/2011 Bowman
2011/0080158 A1 4/2011 Lawrence et al.
2011/0111623 A1 5/2011 Burris et al.
2011/0111626 A1 5/2011 Paglia et al.
2011/0117774 A1 5/2011 Malloy et al.

(56) References Cited

U.S. PATENT DOCUMENTS

| | | | |
|---|---|---|---|
| 2011/0143567 | A1 | 6/2011 | Purdy et al. |
| 2011/0151714 | A1 | 6/2011 | Flaherty et al. |
| 2011/0230089 | A1 | 9/2011 | Amidon et al. |
| 2011/0230091 | A1 | 9/2011 | Krenceski et al. |
| 2011/0237123 | A1 | 9/2011 | Burris et al. |
| 2011/0237124 | A1 | 9/2011 | Flaherty et al. |
| 2011/0250789 | A1 | 10/2011 | Burris et al. |
| 2011/0318958 | A1 | 12/2011 | Burris et al. |
| 2012/0021642 | A1 | 1/2012 | Zraik |
| 2012/0040537 | A1 | 2/2012 | Burris |
| 2012/0045933 | A1 | 2/2012 | Youtsey |
| 2012/0064768 | A1 | 3/2012 | Islam et al. |
| 2012/0094530 | A1 | 4/2012 | Montena |
| 2012/0100751 | A1 | 4/2012 | Montena |
| 2012/0108098 | A1 | 5/2012 | Burris et al. |
| 2012/0122329 | A1 | 5/2012 | Montena |
| 2012/0129387 | A1 | 5/2012 | Holland et al. |
| 2012/0171894 | A1 | 7/2012 | Malloy et al. |
| 2012/0178289 | A1 | 7/2012 | Holliday |
| 2012/0202378 | A1 | 8/2012 | Krenceski et al. |
| 2012/0222302 | A1 | 9/2012 | Purdy et al. |
| 2012/0225581 | A1 | 9/2012 | Amidon et al. |
| 2012/0315788 | A1 | 12/2012 | Montena |
| 2013/0065433 | A1 | 3/2013 | Burris |
| 2013/0072057 | A1 | 3/2013 | Burris |
| 2013/0178096 | A1 | 7/2013 | Matzen |
| 2013/0273761 | A1 | 10/2013 | Ehret et al. |
| 2014/0106612 | A1 | 4/2014 | Burris |
| 2014/0106613 | A1 | 4/2014 | Burris et al. |
| 2014/0120766 | A1 | 5/2014 | Meister et al. |
| 2014/0137393 | A1 | 5/2014 | Chastain et al. |
| 2014/0148051 | A1 | 5/2014 | Bence et al. |
| 2014/0154907 | A1 | 6/2014 | Ehret et al. |
| 2014/0322968 | A1 | 10/2014 | Burris |

FOREIGN PATENT DOCUMENTS

| | | |
|---|---|---|
| CN | 201149937 | 11/2008 |
| CN | 201178228 | 1/2009 |
| CN | 201904508 | 7/2011 |
| DE | 47931 | 10/1888 |
| DE | 102289 | 7/1897 |
| DE | 1117687 | 11/1961 |
| DE | 2261973 | 6/1974 |
| DE | 3211008 | 10/1983 |
| DE | 9001608.4 | 4/1990 |
| DE | 4439852 | 5/1996 |
| DE | 19957518 | 9/2001 |
| EP | 116157 | 8/1984 |
| EP | 167738 | 1/1986 |
| EP | 72104 | 2/1986 |
| EP | 265276 | 4/1988 |
| EP | 428424 | 5/1991 |
| EP | 1191268 | 3/2002 |
| EP | 1501159 | 1/2005 |
| EP | 1548898 | 6/2005 |
| EP | 1603200 | 12/2005 |
| EP | 1701410 | 9/2006 |
| EP | 2051340 | 4/2009 |
| FR | 2232846 | 1/1975 |
| FR | 2462798 | 2/1981 |
| FR | 2494508 | 5/1982 |
| GB | 589697 | 6/1947 |
| GB | 1087228 | 10/1967 |
| GB | 1270846 | 4/1972 |
| GB | 1332888 | 10/1973 |
| GB | 1401373 | 7/1975 |
| GB | 1421215 | 1/1976 |
| GB | 2019665 | 10/1979 |
| GB | 2079549 | 1/1982 |
| GB | 2252677 | 8/1992 |
| GB | 2264201 | 8/1993 |
| GB | 2331634 | 5/1999 |
| GB | 2448595 | 10/2008 |
| GB | 2450248 | 12/2008 |
| JP | 3280369 | 12/1991 |
| JP | 200215823 | 1/2002 |
| JP | 4503793 | 7/2010 |
| KR | 100622526 | 9/2006 |
| TW | 427044 | 3/2001 |
| WO | 8700351 | 1/1987 |
| WO | 0186756 | 11/2001 |
| WO | 02069457 | 9/2002 |
| WO | 2004013883 | 2/2004 |
| WO | 2006081141 | 8/2006 |
| WO | 2007062845 | 6/2007 |
| WO | 2009066705 | 5/2009 |
| WO | 2010135181 | 11/2010 |
| WO | 2011057033 | 5/2011 |
| WO | 2011128665 | 10/2011 |
| WO | 2011128666 | 10/2011 |
| WO | 2012162431 | 5/2012 |
| WO | 2013126629 | 8/2013 |

OTHER PUBLICATIONS

Maury Jr., M.; Microwave Coaxial Connector Technology: A Continuaing Evolution; Maury Microwave Corporation; Dec. 13, 2005; pp. 1-21; Maury Microwave Inc.

"Snap-On/Push-On" SMA Adapter; RF TEC Mfg., Inc.; Mar. 23, 2006; 2 pgs.

RG6 quick mount data sheet; Corning Cabelcon; 2010; 1 pg.; Corning Cabelcon ApS.

RG11 quick mount data sheet; Corning Cabelcon; 2013; 1 pg.; Corning Cabelcon ApS.

Gilbert Engineering Co., Inc.; OEM Coaxial Connectors catalog; Aug. 1993; p. 26.

UltraEase Compression Connectors; "F" Series 59 and 6 Connectors Product Information; May 2005; 4 pgs.

Pomona Electronics Full Line Catelog; vol. 50; 2003; pp. 1-100.

Office Action dated Dec. 31, 2014 pertaining to U.S. Appl. No. 13/605,498.

Office Action dated Dec. 16, 2014 pertaining to U.S. Appl. No. 13/653,095.

Office Action dated Dec. 19, 2014 pertaining to U.S. Appl. No. 13/652,969.

Office Action dated Dec. 29, 2014 pertaining to U.S. Appl. No. 13/833,793.

Office Action dated Sep. 19, 2014 pertaining to U.S. Appl. No. 13/795,780.

Office Action dated Oct. 6, 2014 pertaining to U.S. Appl. No. 13/732,679.

Office Action dated Jun. 12, 2014 pertaining to U.S. Appl. No. 13/795,737.

Election/Restrictions Requirement dated Jul. 31, 2014 pertaining to U.S. Appl. No. 13/652,969.

Office Action dated Aug. 29, 2014 pertaining to U.S. Appl. No. 13/827,522.

Election/Restrictions Requirement dated Jun. 20, 2014 pertaining to U.S. Appl. No. 13/795,780.

Corning Gilbert 2004 OEM Coaxial Products Catalog, Quick Disconnects, 2 pages.

Digicon AVL Connector. ARRIS Group Inc. [online] 3 pages. Retrieved from the Internet: <URL: http://www.arrisi.com/special/digiconAVL.asp.

US Office Action, U.S. Appl. No. 10/997,218; Jul. 31, 2006, pp. 1-10.

Society of Cable Telecommunications Engineers, Engineering Committee, Interface Practices Subcommittee; American National Standard; ANSI/SCTE Jan. 2006; Specification for "F" Port, Female, Outdoor. Published Jan. 2006. 9 pages.

The American Society of Mechanical Engineers; "Lock Washers (Inch Series), An American National Standard"; ASME 818.21.1-1999 (Revision of ASME 618.21.1-1994); Reaffirmed 2005. Published Feb. 11, 2000. 28 pages.

U.S. Reexamination Control No. 90/012,300 filed Jun. 29, 2012, regarding U.S. Pat. No. 8,172,612 filed May 27, 2011 (Bence et al.).

U.S. Reexamination Control No. 90/012,749 filed Dec. 21, 2012, regarding U.S. Pat. No. 7,114,990, filed Jan. 25, 2005 (Bence et al.).

(56) References Cited

OTHER PUBLICATIONS

U.S. Reexamination Control No. 90/012,835 filed Apr. 11, 2013, regarding U.S. Pat. No. 8,172,612 filed May 27, 2011 (Bence et al.).
Notice of Allowance (Mail Date Mar. 20, 2012) for U.S. Appl. No. 13/117,843.
Search Report dated Jun. 6, 2014 pertaining to International application No. PCT/US2014/023374.
Search Report dated Apr. 9, 2014 pertaining to International application No. PCT/US2014/015934.
Society of Cable Telecommunications Engineers, Engineering Committee, Interface Practices Subcommittee; American National Standard; ANSI/SCTE Feb. 2006; "Specification for "F" Port, Female, Indoor". Published Feb. 2006. 9 pages.
PPC, "Next Generation Compression Connectors," pp. 1-6, Retrieved from http://www.tessco.com/yts/partnearnanufacturer list/vendors/ppc/pdf/ppc digital spread.pdf.
Patent Cooperation Treaty, International Search Report for PCT/US2013/070497, Feb. 11, 2014, 3 pgs.
Patent Cooperation Treaty, International Search Report for PCT/US2013/064515, 10 pgs.
Patent Cooperation Treaty, International Search Report for PCT/US2013/064512, Jan. 21, 2014, 11 pgs.
Huber+Suhner AG, RF Connector Guide: Understanding connector technology, 2007, Retrieved from http://www.ie.itcr.ac.cr/marin/lic/e14515/HUBER+SUENER_RF_Connector_Guide.pdf.
Slade, Paul G,. Electrical Contacts: Principles and Applications, 1999, Retrieved from http://books.google.com/books (table of contents only).
U.S. Reexamination Control No. 95/002,400 filed Sep. 15, 2012, regarding U.S. Pat. No. 8,192,237 filed Feb. 23, 2011 (Purdy et al.).
U.S. Reexamination Control No. 90/013,068 filed Nov. 27, 2013, regarding U.S. Pat. No. 6,558,194 filed Jul. 21, 2000 (Montena).
U.S. Reexamination Control No. 90/013,069 filed Nov. 27, 2013, regarding U.S. Pat. No. 6,848,940 filed Jan. 21, 2003 (Montena).
U.S. Inter Partes Review Case No. 2013-00346 filed Jun. 10, 2013, regarding U.S. Pat. No. 8,287,320 filed Dec. 8, 2009, claims 1-8, 10-16, 18-31 (Purdy et al.).
U.S. Inter Partes Review Case No. 2013-00343 filed Jun. 10, 2013, regarding U.S. Pat. No. 8,313,353 filed Apr. 30, 2012, claims 1-6 (Purdy et al.).
U.S. Inter Partes Review Case No. 2013-00340 filed Jun. 10, 2013, regarding U.S. Pat. No. 8,323,060 filed Jun. 14, claims 1-9 (Purdy et al.).
U.S. Inter Partes Review Case No. 2013-00347 filed Jun. 10, 2013, regarding U.S. Pat. No. 8,287,320 filed Dec. 8, 2009, claims 9, 17, 32 (Purdy et al.).
U.S. Inter Partes Review Case No. 2013-00345 filed Jun. 10, 2013, regarding U.S. Pat. No. 8,313,353 filed Apr. 30, 2012, claims 7-27 (Purdy et al.).
U.S. Inter Partes Review Case No. 2013-00342 filed Jun. 10, 2013, regarding U.S. Pat. No. 8,323,060 filed Jun. 14, 2012, claims 10-25 (Purdy et al.).
U.S. Inter Partes Review Case No. 2014-00441 filed Feb. 18, 2014, regarding U.S. Pat. No. 8,562,366 filed Oct. 15, 2012, claims 31,37, 39, 41, 42, 55 56 (Purdy et al.).
U.S. Inter Partes Review Case No. 2014-00440 filed Feb. 18, 2014, regarding U.S. Pat. No. 8,597,041 filed Oct. 15, 2012, claims 1, 8, 9, 11, 18-26, 29 (Purdy et al.).
Notice of Allowance dated Feb. 2, 2015 pertaining to U.S. Appl. No. 13/795,737.
Office Action dated Feb. 18, 2015 pertaining to U.S. Appl. No. 13/827,522.
Office Action dated Mar. 19, 2015 pertaining to U.S. Appl. No. 13/795,780.
Office Action dated Jun. 24, 2015 pertaining to U.S. Appl. No. 13/652,969.

* cited by examiner

COAXIAL CABLE CONNECTOR WITH RADIO FREQUENCY INTERFERENCE AND GROUNDING SHIELD

RELATED APPLICATIONS

This application claims the benefit of priority under 35 U.S.C. §119 of U.S. Provisional Application Ser. No. 61/534,600 filed on Sep. 14, 2011, the content of which is relied upon and incorporated herein by reference in its entirety.

BACKGROUND

1. Field of the Disclosure

The disclosure relates generally to coaxial cable connectors, and particularly to coaxial cable connectors having a flexible, resilient shield which provides radio frequency interference (RFI) and grounding shielding independent of the tightness of the coaxial cable connector to an appliance equipment connection port, and without restricting the movement of the coupler of the coaxial cable connector when being attached to the appliance equipment connection.

2. Technical Background

Coaxial cable connectors, such as type F connectors, are used to attach coaxial cable to another object or appliance, e.g., a television set, DVD player, modem or other electronic communication device having a terminal adapted to engage the connector. The terminal of the appliance includes an inner conductor and a surrounding outer conductor.

Coaxial cable includes a center conductor for transmitting a signal. The center conductor is surrounded by a dielectric material, and the dielectric material is surrounded by an outer conductor; this outer conductor may be in the form of a conductive foil and/or braided sheath. The outer conductor is typically maintained at ground potential to shield the signal transmitted by the center conductor from stray noise, and to maintain continuous desired impedance over the signal path. The outer conductor is usually surrounded by a plastic cable jacket that electrically insulates, and mechanically protects, the outer conductor. Prior to installing a coaxial connector onto an end of the coaxial cable, the end of the coaxial cable is typically prepared by stripping off the end portion of the jacket to expose the end portion of the outer conductor. Similarly, it is common to strip off a portion of the dielectric to expose the end portion of the center conductor.

Coaxial cable connectors of the type known in the trade as "F connectors" often include a tubular post designed to slide over the dielectric material, and under the outer conductor of the coaxial cable, at the prepared end of the coaxial cable. If the outer conductor of the cable includes a braided sheath, then the exposed braided sheath is usually folded back over the cable jacket. The cable jacket and folded-back outer conductor extend generally around the outside of the tubular post and are typically received in an outer body of the connector; this outer body of the connector is often fixedly secured to the tubular post. A coupler is typically rotatably secured around the tubular post and includes an internally-threaded region for engaging external threads formed on the outer conductor of the appliance terminal.

When connecting the end of a coaxial cable to a terminal of a television set, equipment box, or other appliance, it is important to achieve a reliable electrical connection between the outer conductor of the coaxial cable and the outer conductor of the appliance terminal. Typically, this goal is usually achieved by ensuring that the coupler of the connector is fully tightened over the connection port of the appliance. When fully tightened, the head of the tubular post of the connector directly engages the edge of the outer conductor of the appliance port, thereby making a direct electrical ground connection between the outer conductor of the appliance port and the tubular post; in turn, the tubular post is engaged with the outer conductor of the coaxial cable.

With the increased use of self-install kits provided to home owners by some CATV system operators has come a rise in customer complaints due to poor picture quality in video systems and/or poor data performance in computer/internet systems. Additionally, CATV system operators have found upstream data problems induced by entrance of unwanted RF signals into their systems. Complaints of this nature result in CATV system operators having to send a technician to address the issue. Often times it is reported by the technician that the cause of the problem is due to a loose F connector fitting, sometimes as a result of inadequate installation of the self-install kit by the homeowner. An improperly installed or loose connector may result in poor signal transfer because there are discontinuities along the electrical path between the devices, resulting in ingress of undesired radio frequency ("RF") signals where RF energy from an external source or sources may enter the connector/cable arrangement causing a signal to noise ratio problem resulting in an unacceptable picture or data performance. Many of the current state of the art F connectors rely on intimate contact between the F male connector interface and the F female connector interface. If, for some reason, the connector interfaces are allowed to pull apart from each other, such as in the case of a loose F male coupler, an interface "gap" may result. If not otherwise protected this gap can be a point of RF ingress as previously described.

As mentioned above, the coupler is rotatably secured about the head of the tubular post. The head of the tubular post usually includes an enlarged shoulder, and the coupler typically includes an inwardly-directed flange for extending over and around the shoulder of the tubular post. In order not to interfere with free rotation of the coupler, manufacturers of such F-style connectors routinely make the outer diameter of the shoulder (at the head of the tubular post) of smaller dimension than the inner diameter of the central bore of the coupler. Likewise, manufacturers routinely make the inner diameter of the inwardly-directed flange of the coupler of larger dimension than the outer diameter of the non-shoulder portion of the tubular post, again to avoid interference with rotation of the coupler relative to the tubular post. In a loose connection system, wherein the coupler of the coaxial connector is not drawn tightly to the appliance port connector, an alternate ground path may fortuitously result from contact between the coupler and the tubular post, particularly if the coupler is not centered over, and axially aligned with, the tubular post. However, this alternate ground path is not stable, and can be disrupted as a result of vibrations, movement of the appliance, movement of the cable, or the like.

Alternatively, there are some cases in which such an alternate ground path is provided by fortuitous contact between the coupler and the outer body of the coaxial connector, provided that the outer body is formed from conductive material. This alternate ground path is similarly unstable, and may be interrupted by relative movement between the appliance and the cable, or by vibrations. Moreover, this alternate ground path does not exist at all if the outer body of the coaxial connector is constructed of non-conductive material. Such unstable ground paths can give rise to intermittent failures that are costly and time-consuming to diagnose.

SUMMARY OF THE DETAILED DESCRIPTION

One embodiment includes a radio frequency interference (RFI) and grounding shield for a coaxial cable connector. The shield comprises an inner segment and at least one arcuately shaped pre-formed cantilevered annular beam attached to the inner segment by a joining segment. The at least one pre-formed cantilevered annular beam extends angularly from a plane of the circular inner segment. The at least one pre-formed cantilevered annular beam applies a spring-force to a surface of one of the coupler and body of the coaxial cable connector establishing an electrically conductive path between the components. The at least one pre-formed cantilevered annular beam comprises an outer surface with a knife-like edge that provides a wiping action of surface oxides on the coupler surface of the coaxial cable connector and allows for unrestricted movement when the coaxial cable connector is attached to an appliance equipment connection port of an appliance.

A further embodiment includes a coaxial cable connector comprising a tubular post, a coupler, a body and a shield. The body and the post are in intimate electrical and mechanical communication by means of a press-fit between corresponding conductive surfaces. The shield provides an electrically conductive path between the coupler and the body providing a shield against RF ingress. The coaxial cable connector couples a prepared end of a coaxial cable to a threaded female equipment port. The tubular post has a first end adapted to be inserted into the prepared end of the coaxial cable between the dielectric material and the outer conductor thereof. The coupler is rotatably attached over a second end of the tubular post. The coaxial cable connector includes a central bore, at least a portion of which is threaded for engaging the female equipment port. The body extends about the first end of the tubular post for receiving the outer conductor, and preferably the cable jacket, of the coaxial cable.

A resilient, electrically-conductive shield is disposed about the body between the body and the coupler. This shield engages both the body and the coupler for providing an electrically-conductive path therebetween, but without noticeably restricting rotation of the coupler relative to the tubular post. The shield may be generally circular and includes a plurality of pre-formed flexible annular cantilevered beams. The tubular post comprises an enlarged shoulder extending inside the coupler with a first rearward facing annular shoulder and a stepped diameter leading to a second rearward facing annular shoulder. The coupler comprises a forward facing annular surface, a through-bore and a rearward facing annular surface. The body at least partially comprises a face, a through bore and an external annular surface. The shield is disposed between the rearward facing annular surface of the coupler and the body. The pre-formed flexible cantilevered annular beam(s) of the shield are at least partially disposed against the rearward facing annular surface of the coupler. The shield is resilient relative to the longitudinal axis of the connector and maintains an arcuately increased surface of sliding electrical contact between shield and the rearward facing annular surface of the coupler. At the same time the shield is attached to the body providing electrical and mechanical communication between the coupler, and the body while allowing smooth and easy rotation of the coupler. The coaxial cable connector may also include a sealing ring seated within the coupler for rotatably engaging the body member to form a seal therebetween.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION OF THE DRAWINGS

Reference will now be made in detail to the embodiments, examples of which are illustrated in the accompanying drawings, in which some, but not all embodiments are shown. Indeed, the concepts may be embodied in many different forms and should not be construed as limiting herein; rather, these embodiments are provided so that this disclosure will satisfy applicable legal requirements. Whenever possible, like reference numbers will be used to refer to like components or parts.

Coaxial cable connectors are used to couple a prepared end of a coaxial cable to a threaded female equipment connection port of an appliance. The coaxial cable connector may have a post or may be postless. In both cases though, in addition to providing an electrical and mechanical connection between the conductor of the coaxial connector and the conductor of the female equipment connection port, the coaxial cable connector provides a ground path from the braided sheath of the coaxial cable to the equipment connection port. Maintaining a stable ground path protects against the ingress of undesired radio frequency ("RF") signals which may degrade performance of the appliance. This is especially applicable when the coaxial cable connector is loosened from the equipment connection port, either due to not being tightened upon initial installation or due to becoming loose after installation.

Figure 1:
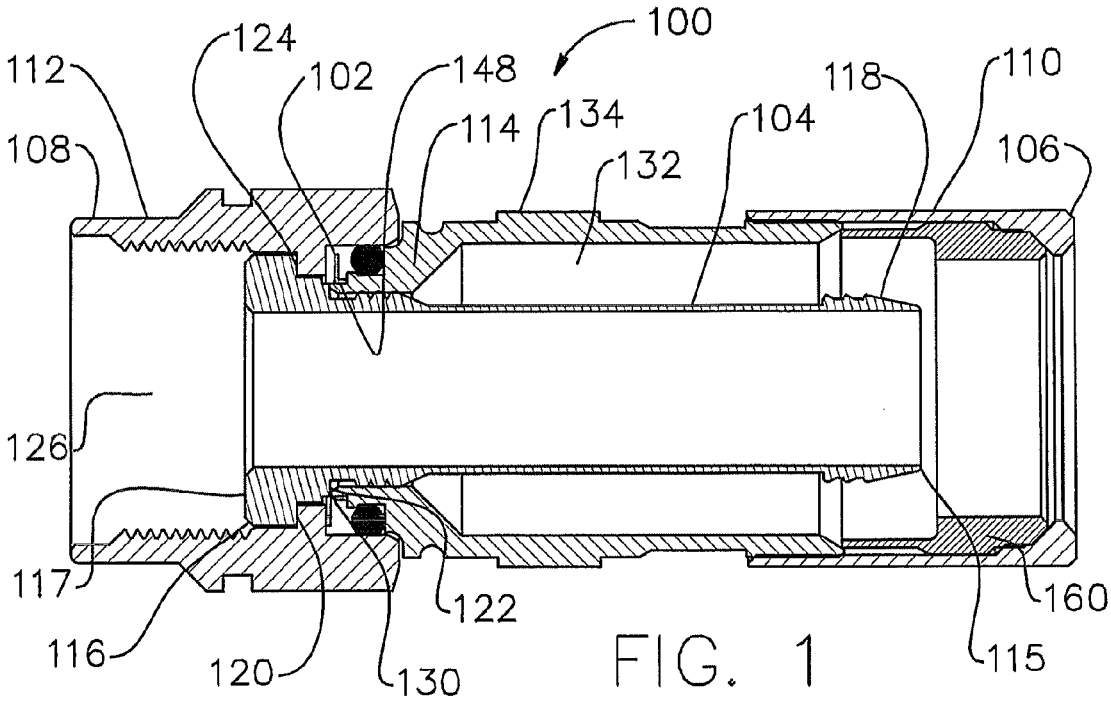
FIG. 1 is a cross sectional view of an embodiment of a type of a coaxial connector with a shield dispose therein.
Figure 1A:
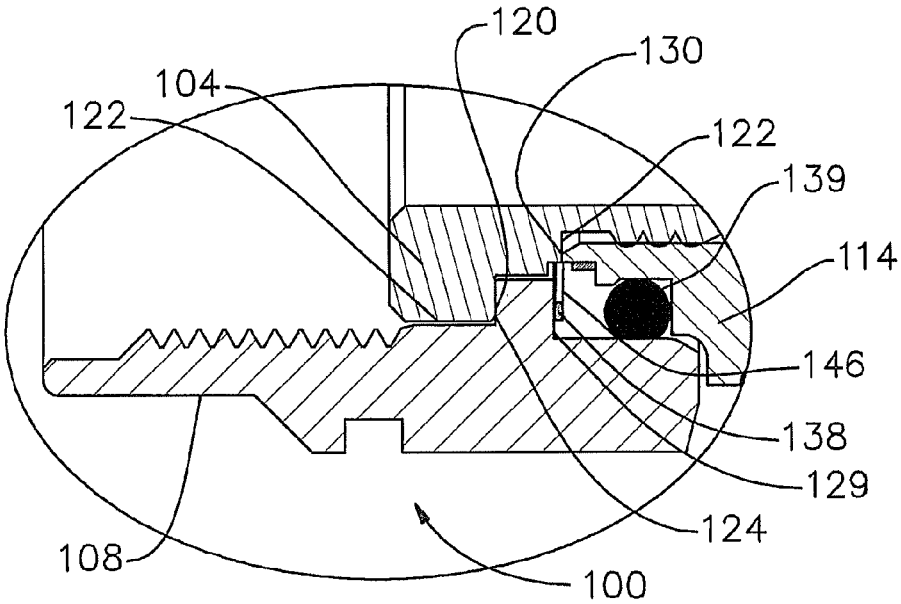
FIG. 1A is a detail section of a portion of FIG. 1.

In this regard, FIGS. 1 and 1A illustrate an exemplary embodiment of coaxial cable connector 100 having a shield 102 to provide a stable ground path and protect against the ingress of RF signals. The coaxial cable connector 100 is shown in its unattached state, without a coaxial cable inserted therein. The coaxial cable connector 100 couples a prepared end of a coaxial cable to a threaded female equipment connection port (not shown in FIG. 1). This will be discussed in more detail with reference to FIG. 7. The coaxial cable connector 100 has a first end 106 and a second end 108. A shell 110 slidably attaches to the coaxial cable connector at the first end 106. A coupler 112 attaches to the coaxial cable connector 100 at the second end 108. The coupler 112 may rotatably attach to the second end 108, and, thereby, also to the tubular post 104. The shield 102 is disposed about the body 114 of the coaxial connector 100. In this way, the shield 102 provides an electrically conductive path between the body 114, and the coupler 112. The shield 102 is prevented from contacting the post by means of a clearance fit between the post features and the shield features. This enables an electrically conductive path from the coaxial cable through the coaxial cable connector 100 to the equipment connection port providing shielding against RF ingress and grounding.

Continuing with reference to FIGS. 1 and 1A, the tubular post 104 has a first end 115 which is adapted to extend into a coaxial cable and a second end 117. An enlarged shoulder 116 at the second end 117 extends inside the coupler 112. At the first end 115, the tubular post 104 has a circular barb 118 extending radially outwardly from the tubular post 104. The enlarged shoulder 116 comprises a first rearward facing annular shoulder 120, and a stepped diameter leading to a second rearward facing annular shoulder 122. The coupler 112 comprises a forward facing annular surface 124, a through-bore 126 and a rearward facing annular surface 129. The body 114 at least partially comprises a face 130, a through bore 132 and an external annular surface 134. An inner surface 148 of the shield 102 is disposed about the body 114 proximate to end 108. In this manner, the shield 102 is secured within the coaxial cable connector 100, and establishes an electrically conductive path between the body 114 and the coupler 112. Further, the shield 102 remains secured independent of the tightness of the coaxial cable connector 100 on the appliance equipment connection port. In other words, the shield 102 remains secured and the electrically conductive path remains established between the body 114 and the coupler 112 even when the coaxial cable connector is loosened and/or disconnected from the appliance equipment connection port. Additionally, the shield 102 has resilient and flexible cantilevered annular beams 138 disposed against the rearward facing annular surface 128 of the coupler 112. In this manner, the cantilevered annular beams 138 maintain contact with the coupler independent of tightness of the coaxial cable connector 100 on the appliance equipment connection port without restricting the movement, including the rotation of the coupler 112. The coaxial cable connector 100 may also include a sealing ring 139 seated within the coupler 112 to form a seal between the coupler 112 and the body 114.

Figure 2:
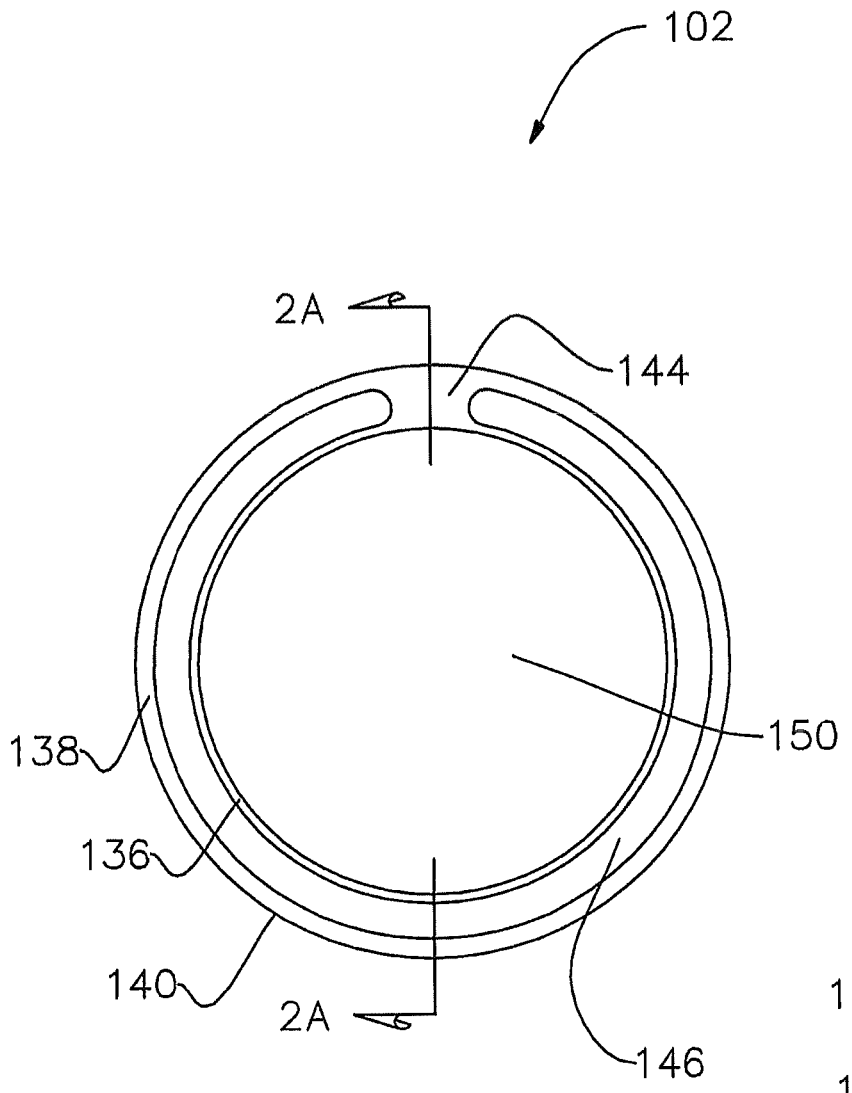
FIG. 2 is a front schematic view of an embodiment of the shield utilized in the connector of FIG. 1.
Figure 2A:
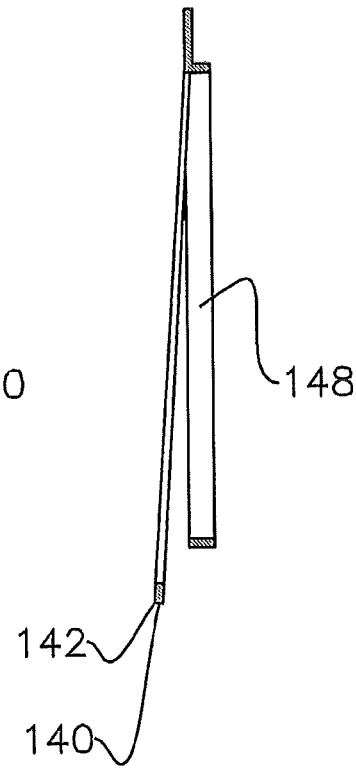
FIG. 2A is a side cross sectional view of the shield shown in FIG. 2.
Figure 3:
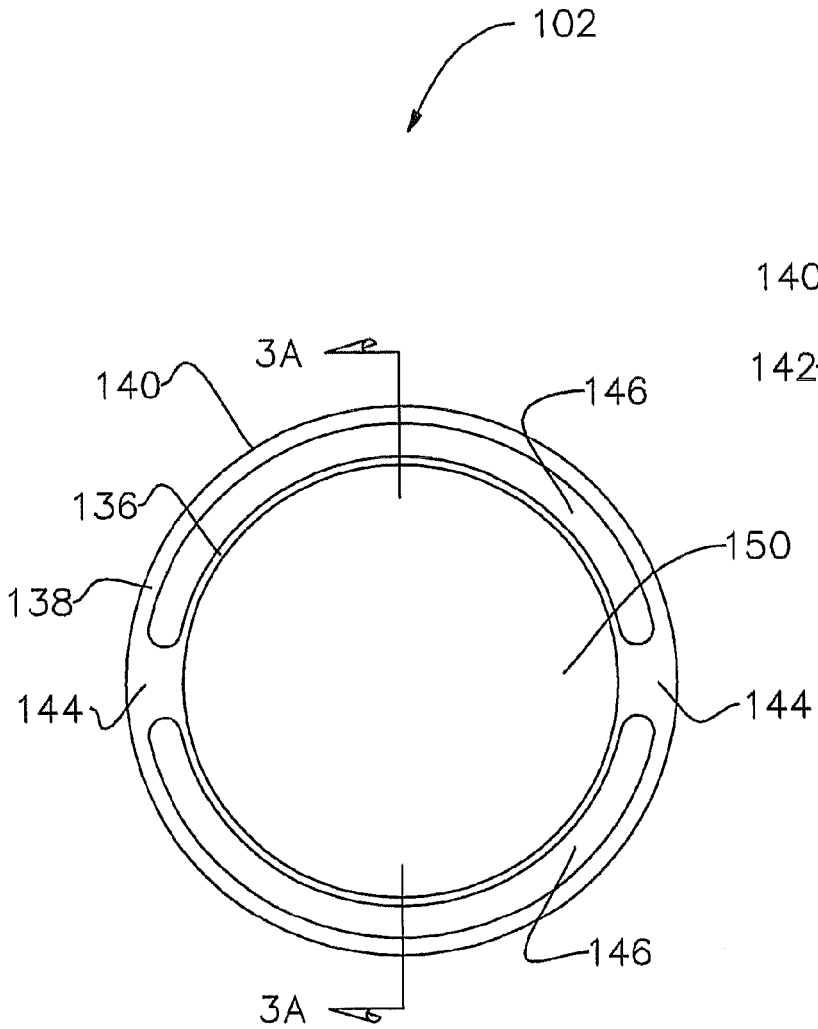
FIG. 3 is a front schematic view of an embodiment of the shield optionally utilized in the connector of FIG. 1.
Figure 3A:
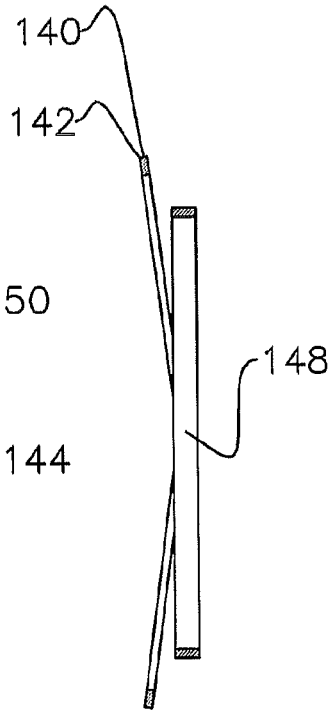
FIG. 3A is a side cross sectional view of the shield shown in FIG. 3.

Referring now to FIGS. 2 and 2A, the shield 102 may be circular with the inner segment 136 and at least one pre-formed cantilevered annular beam 138. The at least one pre-formed cantilevered annular beam 138 is flexible, arcuately shaped and extends at approximately a 19° angle from the plane of the inner segment 136. The pre-formed cantilevered annular beam 138 has an outer surface 140 with an edge 142, as shown in FIG. 2A. Joining segment 144 joins the pre-formed cantilevered annular beam 138 to the inner segment 136 forming a slot 146 therebetween. The inner segment 136 has an inner surface 148 that defines a central aperture 150. The shield 102 may be made from a metallic material, including as a non-limiting example, phosphor bronze, and have a width of approximately 0.005 inches. Additionally or alternatively, the shield 102 may be un-plated or plated with a conductive material, as non-limiting examples tin, tin-nickel or the like Referring now to FIGS. 3 and 3A, the shield 102 may be circular with the inner segment 136 and may have a plurality of pre-formed cantilevered annular beams 138. The pre-formed cantilevered annular beams 138 are flexible, arcuately shaped and extend at approximately a 19° angle from the plane of the inner segment 136. The pre-formed cantilevered annular beams 138 have an outer surface 140 with an edge 142, as shown in FIG. 3A. Joining segments 144 join the plurality of the pre-formed cantilevered annular beams 138 to the inner segment 136 forming a plurality of slots 146 therebetween. The inner segment 136 has an inner surface 148 that defines a central aperture 150. Shield 102 may be made from a metallic material, including as a non-limiting example, phosphor bronze, and have a width of approximately 0.005 inches. Additionally or alternatively, the shield 102 may be un-plated or plated with a conductive material, as non-limiting examples tin, tin-nickel or the like Pre-forming the cantilevered annular beams 138 as illustrated in FIGS. 2A and 3A, provides improved application of the material properties of the shield 102 to provide a spring force biasing the edge 142 toward the rearward facing annular surface 129 and causing the edge 142 of outer surface 140 to intimately contact rearward facing annular surface 129 of the coupler 112. Because of this, the shield 102 may be manufactured without having to utilize a more expensive material such as beryllium copper. Additionally, the material of the shield 102 does not need to be heat treated. Further, the natural spring-like qualities of the selected material are utilized, with the modulus of elasticity preventing the shield 102 from being over-stressed by providing for limited relative axial movement between coupler 112, the tubular post 104 and the body 114

Electrical grounding properties are enhanced by providing an arcuately increased area of surface engagement between the edges 142 of the cantilevered annular beams 138 and rearward facing annular surface 129 of coupler 112 as compared, for example, to the amount of surface engagement of individual, limited number of contact points, such as raised bumps and the like. In this manner, the increased area of surface engagement provides the opportunity to engage a greater number of Asperity spots ("A-spots") rather than relying on the limited number of mechanical and A-spot points of engagement. Additionally, the edge 142 may have a knife-like sharpness. Thus, the knife-like sharpness of the edge 142 makes mechanical contact between the cantilevered annular beams 138 and rearward facing annular surface 129 of coupler 112 without restricting the movement of the coupler 112. Also, the knife-like sharpness of the edge 142 and the plating of shield 102 provide a wiping action of surface oxides to provide for conductivity during periods of relative motion between the components.

Moreover, in addition to the increased number of A-spot engagement, the increased area of surface engagement results in an increased area of concentrated, mechanical pressure. While providing the degree of surface contact and concentrated mechanical force, the shield 102 does not negatively impact the "feel" of coupler rotation due to the limited amount of frictional drag exerted by the profile of edges 142 against reward facing annular surface 128.

The shield 102 is resilient relative to the longitudinal axis of the coaxial cable connector 100 and maintains an arcuately increased surface of sliding electrical contact between shield 102 and the rearward facing annular surface 129 of the coupler 112. At the same time the shield is firmly mounted and grounded to the body 114 providing assured electrical and mechanical communication between the coupler 106, the body 114 while allowing smooth and easy rotation of the coupler 112.

Figure 4:
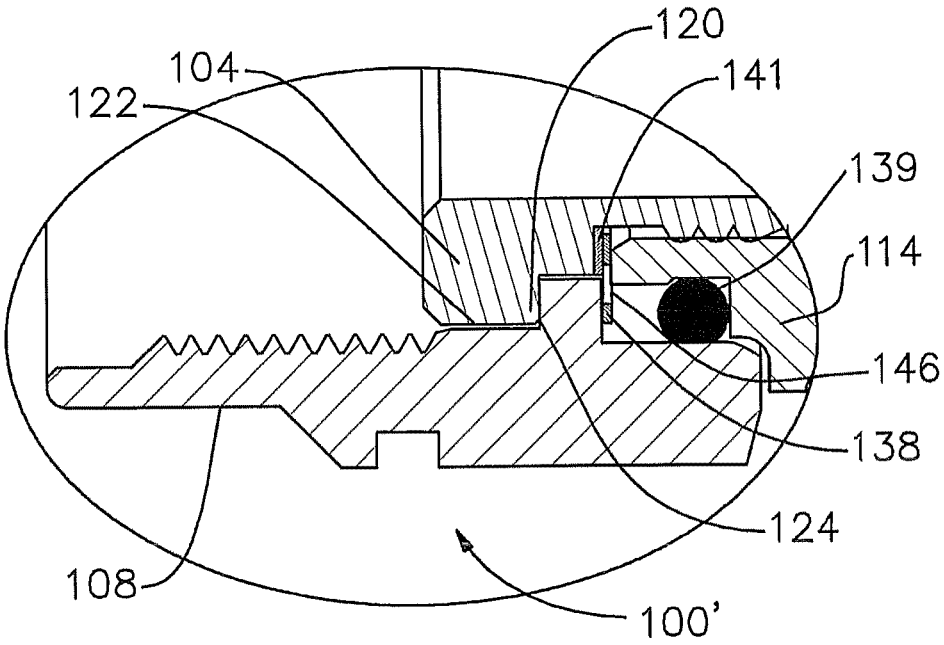
FIG. 4 is a detail sectional view of an alternate embodiment of the invention wherein the shield is isolated from the post by means of an insulative member.

Referring now to FIG. 4, there is shown a detail view of the shield 102 disposed in another coaxial cable connector 100'. In FIG. 4 the shield 102 is in contact with the body 114 but isolated from the post 104 by an insulative member 139 that is interposed between the post 104 and the shield 102.

Figure 5:
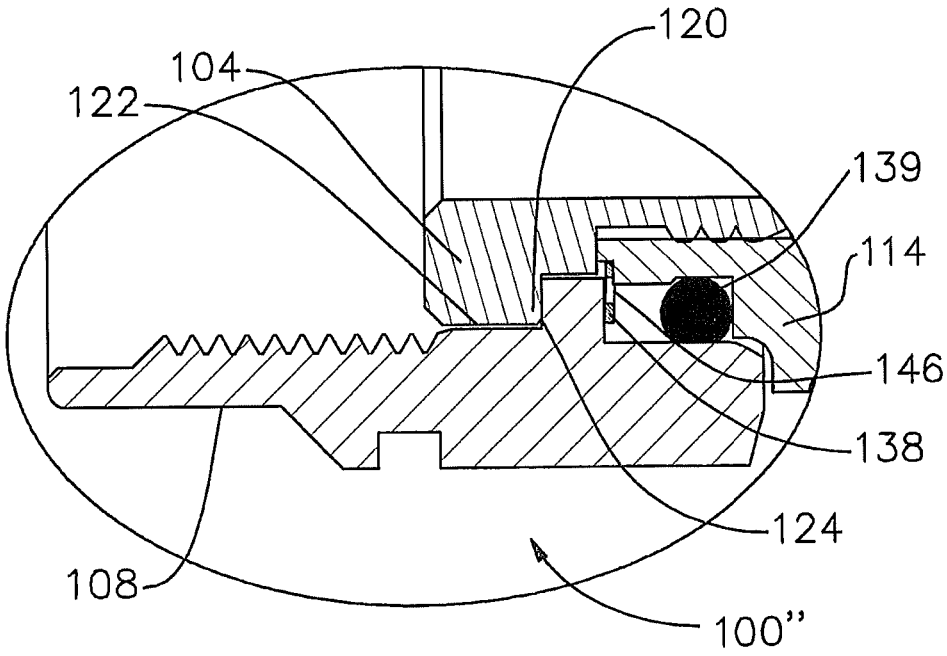
FIG. 5 is a detail sectional view of an alternate embodiment of the invention wherein the shield is isolated from the post by means of fitment with the body.

Referring now to FIG. 5, there is shown a detail view of the shield 102 disposed in another coaxial cable connector 100". In FIG. 5 the shield 102 is in intimate contact with the body 114 but isolated from the post 104 by the physical step configuration of the body 114.

Figure 6:
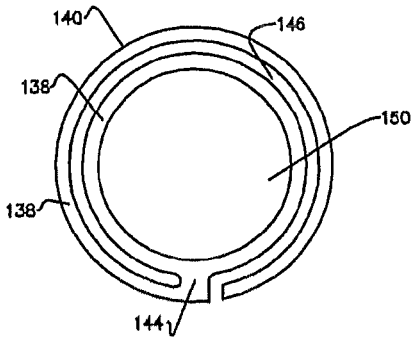
FIGS. 6 through 6D are front schematic views of embodiments of the shield.
Figure 6A:
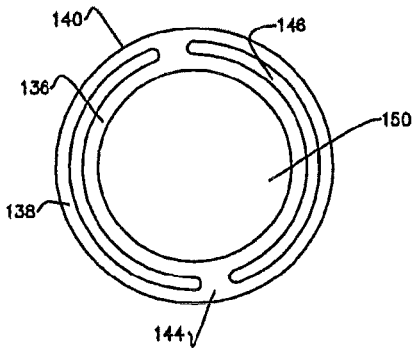
Figure 6B:
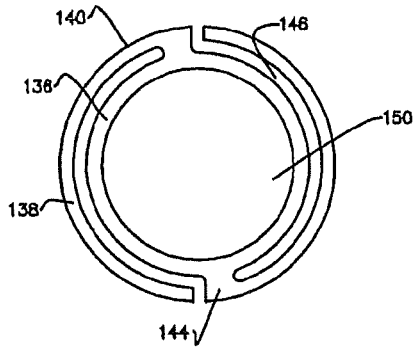
Figure 6C:
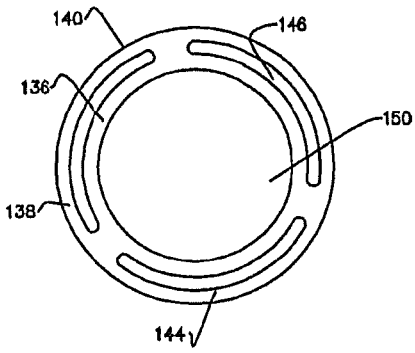
Figure 6D:
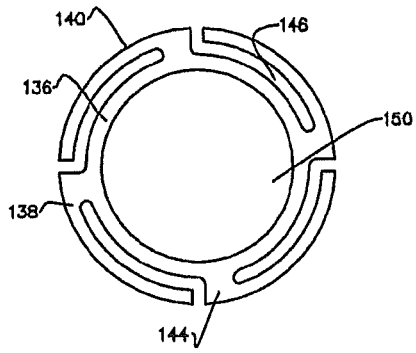

FIGS. 6 through 6D illustrate optional embodiments of the shield 102 with differing patterns of slots 146, cantilevered annular beams 138, and the joining segments 144. Slots 146 may break through one side of the cantilevered beams 138 forming a single ended cantilevered beam or, alternatively, may not break out through one side of the cantilevered beam forming a double ended cantilevered beam. Endless variations and patterns may be achieved.

Figure 7:
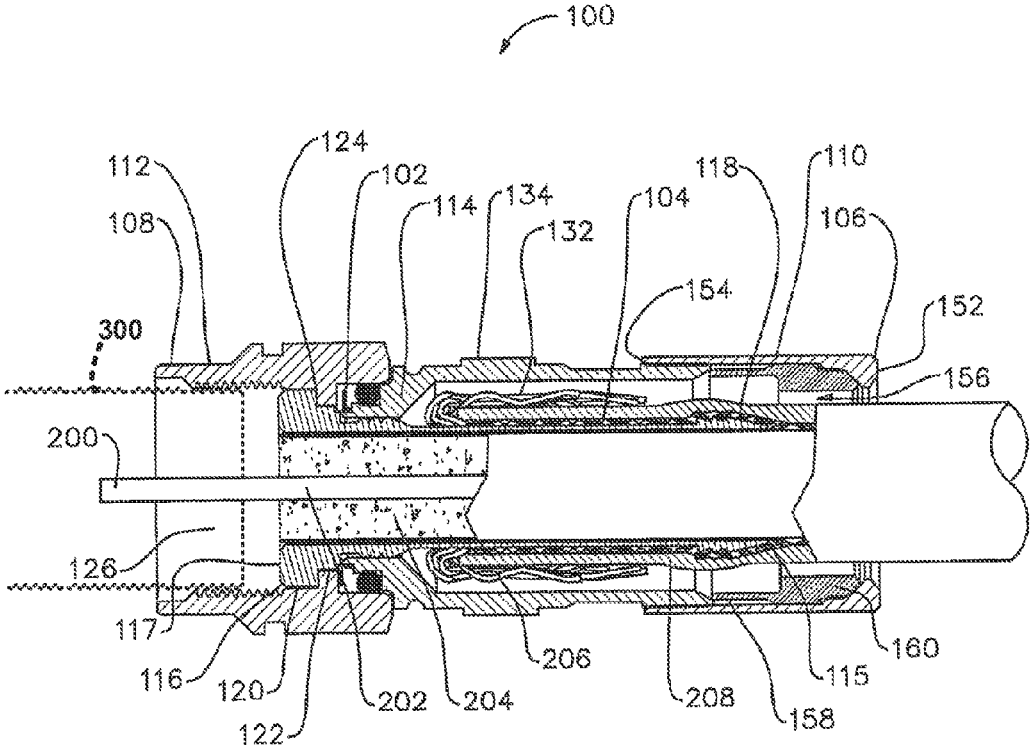
FIG. 7 is a cross sectional view of the coaxial connector of FIG. 1 with a coaxial cable disposed therein.

Referring now to FIG. 7, the coaxial cable connector 100 is shown with a coaxial cable 200 inserted therein. The shell 106 has a first end 152 and an opposing second end 154. The shell 106 may be made of metal. A central passageway 156 extends through the shell 106 between first end 152 and the second end 154. The central passageway 156 has an inner wall 158 with a diameter commensurate with the outer diameter of the external annular surface 134 of the body 112 for allowing the second end 154 of the shell 106 to extend over the body 112. A gripping ring or member 160 (hereinafter referred to as "gripping member") is disposed within the central passageway 156 of the shell 106. The central passageway 156 proximate the first end 152 of shell 106 has an inner diameter that is less than the diameter of the inner wall 158.

The coaxial cable 200 has center conductor 202. The center conductor 202 is surrounded by a dielectric material 204, and the dielectric material 204 is surrounded by an outer conductor 206 that may be in the form of a conductive foil and/or braided sheath. The outer conductor 206 is usually surrounded by a plastic cable jacket 208 that electrically insulates, and mechanically protects, the outer conductor. A prepared end of the coaxial cable 200 is inserted into the first end 106 of the coaxial cable connector 100. The coaxial cable 200 is fed into the coaxial cable connector 100 such that the circular barb 118 of the tubular post 104 inserts between the dielectric material 204 and the outer conductor 206 of the coaxial cable 200, making contact with the outer conductor 206. A tool (not shown) advances the shell 106 toward the coupler 112. As the shell 106 is advanced over the external annular surface 134 of the body 114 toward the coupler 112, the reduced diameter of the central passageway 156 forces the gripping member 160 against the cable jacket 208. In this manner, the coaxial cable 200 is retained in the coaxial cable connector 100. Additionally, the circular barb 118 positioned between the dielectric material 204 and the outer conductor 206 acts to maximize the retention strength of the cable jacket 202 within coaxial cable connector 100. As the shell 106 moves toward the second end of the coaxial cable connector 100, the shell 106 forces the gripper member 160 between the body 114 and the cable jacket 202. In this manner, the cable jacket 202 is captured between the gripper member 160 and the circular barb 118 increasing the pull-out force required to dislodge cable 200 from coaxial cable connector 100. Since the outer conductor 206 is in contact with the tubular post 104 an electrically conductive path is established from the outer conductor 206 through the tubular post 104 to the body 114 to the shield 102 and, thereby, to the coupler 112.

Further, the shield 102 secured within the connector 100 and the electrically-conductive path remains established independent of the tightness of the coaxial cable connector 100 on the appliance equipment connection port 300. In other words, the shield 102 remains secured and the electrically conductive path remains established between the body 114 and coupler 112 even when the coaxial cable connector is loosened and/or disconnected from the appliance equipment connection port Additionally, the shield 102 has resilient and flexible cantilevered annular beams 138 disposed against the rearward facing annular surface 129 of the coupler 112. In this manner, the cantilevered annular beams 138 maintain contact with the coupler independent of tightness of the coaxial cable connector 100 on the appliance equipment connection port without restricting the movement, including the rotation of the coupler 112.

It will be apparent to those skilled in the art that various modifications and variations can be made to the embodiments discussed above. Additionally, the embodiments of the shield 102 may be used with other types of coaxial cable connector shield including without limitation, compression, compression-less and post-less coaxial cable connectors. Thus, it is intended that this description cover the modifications and variations of the embodiments and their applications.

What is claimed is:

1. An RFI and resilient grounding shield for a coaxial cable connector having a coupler and a body, the shield, comprising:

an inner segment, wherein the inner segment is configured to contact the body of the connector;

at least one pre-formed planar double ended cantilevered annular beam attached to the inner segment and angularly extending from a plane of the inner segment, wherein the at least one preformed cantilevered annular beam is configured to apply a spring-force to a surface of the coupler establishing an electrically conductive path between body and the coupler coaxial cable connector when the shield is positioned in the coaxial cable connector, wherein the inner segment has an inner surface that defines an aperture and an outer surface of the body contacts the inner surface.

2. The shield of claim 1, wherein the inner segment is configured to friction fit to the connector body.

3. The shield of claim 1, wherein the inner segment is generally circular.

4. The shield of claim 1, wherein the at least one preformed cantilevered annular beam is arcuately shaped.

5. The shield of claim 1, wherein the at least one preformed cantilevered annular beam comprises an outer surface with an edge, and wherein the edge has a knife-like sharpness and provides a wiping action of surface oxides on the coupler of the coaxial cable connector.

6. The shield of claim 1, wherein the inner segment and the at least one pre-formed cantilevered annular beam are metallic.

7. The shield of claim 6, wherein the inner segment and the at least one pre-formed cantilevered annular beam are formed of phosphor bronze.

8. The shield of claim 1, further comprising a conductive material plating.

9. The shield of claim 8, wherein the conductive material plating is one of tin and tin-nickel.

10. The shield of claim 1, wherein the at least one pre-formed cantilevered annular beam comprises a plurality of pre-formed cantilevered annular beams.

11. A coaxial cable connector for coupling a coaxial cable to an equipment port, the coaxial cable including a center conductor surrounded by a dielectric material, the dielectric material being surrounded by an outer conductor, the coaxial cable connector comprising:

a tubular post having a first end adapted to be inserted into the prepared end of the coaxial cable between the dielectric material and the outer conductor, and having a second end opposite the first end thereof;

a coupler having a first end rotatably secured over the second end of the tubular post, and having an opposing second end, the coupler including a central bore extending therethrough, a portion of the central bore proximate the second end of the coupler being adapted for engaging the equipment port;

a body secured to the tubular post and extending outwardly from the first end of the tubular post for receiving the outer conductor of the coaxial cable, the body comprising an inner surface generally facing the tubular post and an outer surface generally facing away from the tubular post;

a resilient, electrically-conductive shield having an inner segment and at least one pre-formed cantilevered annular beam exerting a spring-like force on the coupler, the inner segment comprising an inner surface defining a central aperture, the inner surface disposed about and in contact with the outer surface of the body, wherein the shield provides an electrically-conductive path between the body and the coupler, and wherein the shield remains captured and secured and provides the electrically-conductive path independent of the tightness of the coaxial cable connector.

12. The coaxial cable connector of claim 11, wherein the shield is generally circular and the at least one pre-formed cantilevered annular beam is planar and arcuately shaped.

13. The coaxial cable connector of claim 11, wherein the second end of the tubular post has an enlarged shoulder comprising a first rearward facing annular shoulder and a second rearward facing annular shoulder.

14. The coaxial cable connector of claim 11, wherein the coupler comprises a rearward facing annular surface, and wherein the at least one pre-formed cantilevered annular beam exerts a spring-like force on the coupler at the rearward facing annular surface.

15. The coaxial cable connector of claim 11, wherein the shield is resilient relative to the longitudinal axis of the connector and maintains an arcuately increased surface of sliding electrical contact between the shield and the rearward facing annular surface of the coupler.

16. The coaxial cable connector of claim 11, wherein the at least one pre-formed cantilevered annular beam comprises an outer surface with an edge, and wherein the edge has a knife-like sharpness and provides a wiping action of surface oxides on a surface of the coupler.

17. The coaxial cable connector of claim 11, wherein the shield provides for unrestricted rotation of the coupler.

18. The coaxial cable connector of claim 11, wherein the shield maintains the electrically conductive path between the coaxial cable conductor and an equipment connection port of an appliance when the coupler is loosened from while in contact with the equipment connection port.

19. The coaxial cable connector of claim 11, wherein the shield provides the electrically-conductive path between the body and the coupler without contacting the tubular post.

20. The coaxial cable connector of claim 19, wherein the shield is prevented from contacting the tubular post via a clearance fit between the tubular post and the shield.

* * * * *